US008538608B2

(12) United States Patent
Meltser et al.

(10) Patent No.: US 8,538,608 B2
(45) Date of Patent: Sep. 17, 2013

(54) CONTROL SYSTEM AND METHOD FOR REMOTELY ISOLATING POWERED UNITS IN A RAIL VEHICLE SYSTEM

(75) Inventors: Mikhail Meltser, Hanover Park, IL (US); Timothy Medema, Algonquin, IL (US); John Brand, Melbourne, FL (US); Jared Klineman Cooper, Palm Bay, FL (US); Todd Goodermuth, Satellite Beach, FL (US); David Allen Eldredge, Malabar, FL (US); Robert Foy, Melbourne, FL (US); Christopher McNally, Girard, PA (US); Joseph Forrest Noffsinger, Lees Summit, MO (US); David McKay, Melbourne, FL (US); Patricia Lacy, Lawrence Park, PA (US); Kristopher Smith, Satellite Beach, FL (US)

(73) Assignee: General Electric Company, Schenectady, NY (US)

( * ) Notice: Subject to any disclaimer, the term of this patent is extended or adjusted under 35 U.S.C. 154(b) by 923 days.

(21) Appl. No.: 12/556,334

(22) Filed: Sep. 9, 2009

(65) Prior Publication Data

US 2011/0060486 A1 Mar. 10, 2011

(51) Int. Cl.
*G05D 11/00* (2006.01)
*G06F 17/00* (2006.01)

(52) U.S. Cl.
USPC ..... 701/19; 249/187 C; 701/20; 701/2; 701/123; 60/706; 60/711

(58) Field of Classification Search
USPC ..... 701/2, 19, 123; 246/167 R, 187 C; 340/4.3, 4.31, 4.32; 455/522, 517, 507; 105/61; 60/706, 711
See application file for complete search history.

(56) References Cited

U.S. PATENT DOCUMENTS 4,041,283 A 8/1977 Mosier
4,042,810 A 8/1977 Mosher
(Continued)

FOREIGN PATENT DOCUMENTS

DE 19645426 7/1997
EP 0114633 1/1984
(Continued)

OTHER PUBLICATIONS

Full process control strategy of fuel based on water-coal ratio of ultra supercritical units; Fengping Pan; Yaqing Zhu; Xi Zhang Electronics, Communications and Control (ICECC), 2011 International Conference on; Digital Object Identifier: 10.1109/ICECC.2011.6068015; Publication Year: 2011 , pp. 3750-3753.*
(Continued)

*Primary Examiner* — Cuong H Nguyen
(74) *Attorney, Agent, or Firm* — GE Global Patent Operation; John A. Kramer

(57) ABSTRACT

A control system for a rail vehicle system including a lead powered unit and a remote powered unit is provided. The system includes a user interface, a master isolation module and a slave controller. The user interface is disposed in the lead powered unit and is configured to receive an isolation command to turn on or off the remote powered unit. The master isolation module is configured to receive the isolation command from the user interface and to communicate an instruction based on the isolation command. The slave controller is configured to receive the instruction from the master isolation module. The slave controller causes the remote powered unit to supply tractive force to propel the rail vehicle system when the instruction directs the slave controller to turn on the remote powered unit. The slave controller causes the remote powered unit to withhold the tractive force when the instruction directs the slave controller to turn off the remote powered unit.

21 Claims, 4 Drawing Sheets

(56) References Cited

U.S. PATENT DOCUMENTS

| | | | | |
|---|---|---|---|---|
| 4,181,943 | A | 1/1980 | Hugg et al. | |
| 4,344,364 | A * | 8/1982 | Nickles et al. | 105/62.1 |
| 4,361,202 | A * | 11/1982 | Minovitch | 180/168 |
| 4,602,335 | A | 7/1986 | Perlmutter | |
| 5,744,707 | A | 4/1998 | Kull | |
| 6,862,502 | B2 * | 3/2005 | Peltz et al. | 701/19 |
| 6,904,110 | B2 * | 6/2005 | Trans et al. | 375/350 |
| 7,395,141 | B1 | 7/2008 | Seck et al. | |
| 2003/0034423 | A1 * | 2/2003 | Hess et al. | 246/167 R |
| 2003/0213875 | A1 * | 11/2003 | Hess et al. | 246/167 R |
| 2003/0214417 | A1 * | 11/2003 | Peltz et al. | 340/825 |
| 2004/0104312 | A1 * | 6/2004 | Hess et al. | 246/186 |
| 2005/0143874 | A1 * | 6/2005 | Peltz et al. | 701/19 |
| 2005/0186325 | A1 * | 8/2005 | Luangthep | 427/4 |
| 2005/0186933 | A1 * | 8/2005 | Trans | 455/296 |
| 2008/0183345 | A1 * | 7/2008 | Chandra et al. | 701/19 |
| 2009/0186325 | A1 * | 7/2009 | Kumar | 434/219 |
| 2011/0060486 | A1 * | 3/2011 | Meltser et al. | 701/19 |
| 2011/0118899 | A1 * | 5/2011 | Brooks et al. | 701/2 |
| 2011/0118914 | A1 * | 5/2011 | Brooks et al. | 701/20 |

FOREIGN PATENT DOCUMENTS

| | | |
|---|---|---|
| EP | 0257662 | 2/1988 |
| EP | 0539885 | 5/1993 |
| EP | 0755840 | 1/1997 |
| GB | 2188464 | 9/1987 |
| WO | WO 9003622 | 5/1990 |
| WO | WO 99/14093 | 3/1999 |

OTHER PUBLICATIONS

The Research and Application of 1089 t/h Circulating Fluidized Bed Unit Coordinate Control System; Xin Xiaogang; Wang Biao; Qin Chenguo; Zhang Xiwei; E-Product E-Service and E-Entertainment (ICEEE), 2010 International Conference on Digital Object Identifier: 10.1109/ICEEE.2010.5661545; Pub. Year: 2010 , pp. 1-4.*

Application of electrically peaking hybrid (ELPH) propulsion system to a full-size passenger car with simulated design verification Ehsani, M.; Yimin Gao; Butler, K.L.; Vehicular Technology, IEEE Transactions on; vol. 48 , Issue: 6 Digital Object Identifier: 10.1109/25.806770; Publication Year: 1999 , pp. 1779-1787.*

Remote Maintenance Techniques Proposed for the 200-GeV Accelerator; Krevitt, Roland; Nuclear Science, IEEE Transactions on vol. 14 , Issue: 3; Digital Object Identifier: 10.1109/TNS.1967.4324695; Publication Year: 1967 , pp. 997-1003.*

Artificial Neural Networks and regression approaches comparison for forecasting Iran's annual electricity loadl; Ghanbari, Arash ; Naghavi, A. ; Ghaderi, Seyed Farid, Jr. ; Sabaghian, M.;Power Engineering, Energy and Electrical Drives, 2009. POWERENG '09. Interl Conf on; Digital Object Id: 10.1109/POWERENG.2009.4915245; Pub. Yr 2009 , pp. 675-679.*

Evaluation of Locomotive Cable Insulation Life Under Varying Temperature Loading; Kiersztyn, Stanley E. ; Wahl, Ralph E. ; Wu, Alexander F. ; Moon, Charles G. ; Jones, S. PauL; Industry Applications, IEEE Transactions on; vol. IA-21 , Issue: 4 Digital Object Identifier: 10.1109/TIA.1985.349536; Publication Year: 1985 , pp. 882-888.*

The analysis of GSM-R redundant network and reliability models on high-speed railway; Xun, Ding ; Xin, Chen ; Wenyi, Jiang Electronics and Information Engineering (ICEIE), 2010 International Conference On; vol. 2 Digital Object Identifier: 10.1109/ICEIE.2010.5559737; Publication Year: 2010 , pp. V2-154-V2-158.*

The Research on the Mechanism of Limiting Speed Pick-Up and Set-Out Train on Railway Transportation Capacity Loss Wang Xin-Yu ; Chen Zhi-ya ; Zhang Ying-gui ; Tang Bo; Intelligent Computation Technology and Automation, 2009. ICICTA '09. Second Inter Conf. on; vol. 3; Digital Object Id: 10.1109/ICICTA.2009.666; Pub YR. 2009 , pp. 830-833.*

International Search Report issued in corresponding PCT Application No. PCT/US2010/045402.

Written Opinion issued in corresponding PCT Application No. PCT/US2010/045402.

* cited by examiner

CONTROL SYSTEM AND METHOD FOR REMOTELY ISOLATING POWERED UNITS IN A RAIL VEHICLE SYSTEM

BACKGROUND OF THE INVENTION

This invention relates generally to powered rail vehicle systems.

Known powered rail vehicle systems include one or more powered units and, in certain cases, one or more non-powered rail cars. The powered units supply tractive force to propel the powered units and cars. The non-powered cars hold or store goods and/or passengers. ("Non-powered" rail car generally encompasses any rail car without an on-board source of motive power.) For example, some known powered rail vehicle systems include a rail vehicle system (e.g., train) having locomotives and cars for conveying goods and/or passengers along a track. Some known powered rail vehicle systems include several powered units. For example, the systems may include a lead powered unit, such as a lead locomotive, and one or more remote or trailing powered units, such as trailing locomotives, that are located behind and (directly or indirectly) coupled with the lead powered unit. The lead and remote powered units supply tractive force to propel the vehicle system along the track.

The tractive force required to convey the powered units and cars along the track may vary during a trip. For example, due to various parameters that change during a trip, the tractive force that is necessary to move the powered units and the cars along the track may vary. These changing parameters may include the curvature and/or grade of the track, speed limits and/or requirements of the system, and the like. As these parameters change during a trip, the total tractive effort, or force, that is required to propel the vehicle system along the track also changes.

While the required tractive effort may change during a trip, the operators of these powered rail vehicle systems do not have the ability to remotely turn the electrical power systems of remote powered units on or off during the trip. For example, an operator in a lead locomotive does not have the ability to remotely turn one or more of the trailing locomotives' electrical power on or off, if the tractive effort required to propel the train changes during a segment of the trip while the rail vehicle system is moving. Instead, the operator may only have the ability to locally turn on or off the remote powered units by manually boarding each such unit of the rail vehicle system.

Some known powered rail vehicle systems provide an operator in a lead locomotive with the ability to change the throttle of trailing locomotives (referred to as distributed power operations). But, these known systems do not provide the operator with the ability to turn the trailing locomotives off. Instead, the operator must turn down the throttle of the trailing locomotives that he or she wants to turn off and wait for an auto engine start/stop (AESS) device in the trailing locomotives to turn the locomotives off. Some known AESS devices do not turn the trailing locomotives off until one or more engine- or motor-related parameters are within a predetermined range. For example, some known AESS devices may not shut off the engine of a trailing locomotive until the temperature of the engine decreases to a predetermined threshold. If the time period between the operator turning down the throttle of the trailing locomotives and the temperature of the engines decreasing to the predetermined threshold is significant, then the amount of fuel that is unnecessarily consumed by the trailing locomotives can be significant.

BRIEF DESCRIPTION OF THE INVENTION

In one embodiment, a control system for a rail vehicle system including a lead powered unit and a remote powered unit is provided. The system includes a user interface, a master isolation module, and a slave controller. The user interface is disposed in the lead powered unit and is configured to receive an isolation command to turn on or off the remote powered unit. The master isolation module is configured to receive the isolation command from the user interface and to communicate an instruction based on the isolation command. The slave controller is configured to receive the instruction from the master isolation module. The slave controller causes the remote powered unit to supply tractive force to propel the rail vehicle system when the instruction directs the slave controller to turn on the remote powered unit. The slave controller causes the remote powered unit to withhold the tractive force when the instruction directs the slave controller to turn off the remote powered unit.

In another embodiment, a method for controlling a rail vehicle system that includes a lead powered unit and a remote powered unit is provided. The method includes providing a user interface in the lead powered unit to receive an isolation command to turn on or off the remote powered unit and a slave controller in the remote powered unit. The method also includes communicating an instruction based on the isolation command to the slave controller and directing the slave controller to cause the remote powered unit to supply tractive force to propel the rail vehicle system when the instruction directs the slave controller to turn on the remote powered unit and to cause the remote powered unit to withhold the tractive force when the instruction directs the slave controller to turn off the remote powered unit.

In another embodiment, a computer readable storage medium for a control system of a rail vehicle system is having a lead powered unit and a remote powered unit is provided. The lead powered unit includes a microprocessor and the remote powered unit includes a slave isolation module and a slave controller. The computer readable storage medium includes instructions to direct the microprocessor to receive an isolation command to turn on or off the remote powered unit. The instructions also direct the microprocessor to communicate an instruction based on the isolation command. The slave controller receives the instruction to cause the remote powered unit to supply tractive force to propel the rail vehicle system when the instruction directs the slave controller to turn on the remote powered unit and to withhold the tractive force when the instruction directs the slave controller to turn off the remote powered unit.

In another embodiment, a method for controlling a train having a lead locomotive and a remote locomotive is provided. The method includes communicating an instruction that relates to an operational state of the remote locomotive from the lead locomotive to the remote locomotive. The method also includes controlling an engine of the remote locomotive at the remote locomotive based on the instruction into one of an on operational state and an off operational state. The engine does not combust fuel during at least a portion of a time period when the engine is in the off operational state.

As should be appreciated, the control system, method, and computer readable storage medium remotely adjust the tractive force provided by powered units in a powered rail vehicle system by turning powered units in the system on or off. Such a system, method, and computer readable storage medium can improve some known rail vehicle systems by reducing the amount of fuel that is consumed during a trip.

DETAILED DESCRIPTION OF THE INVENTION

Figure 1:
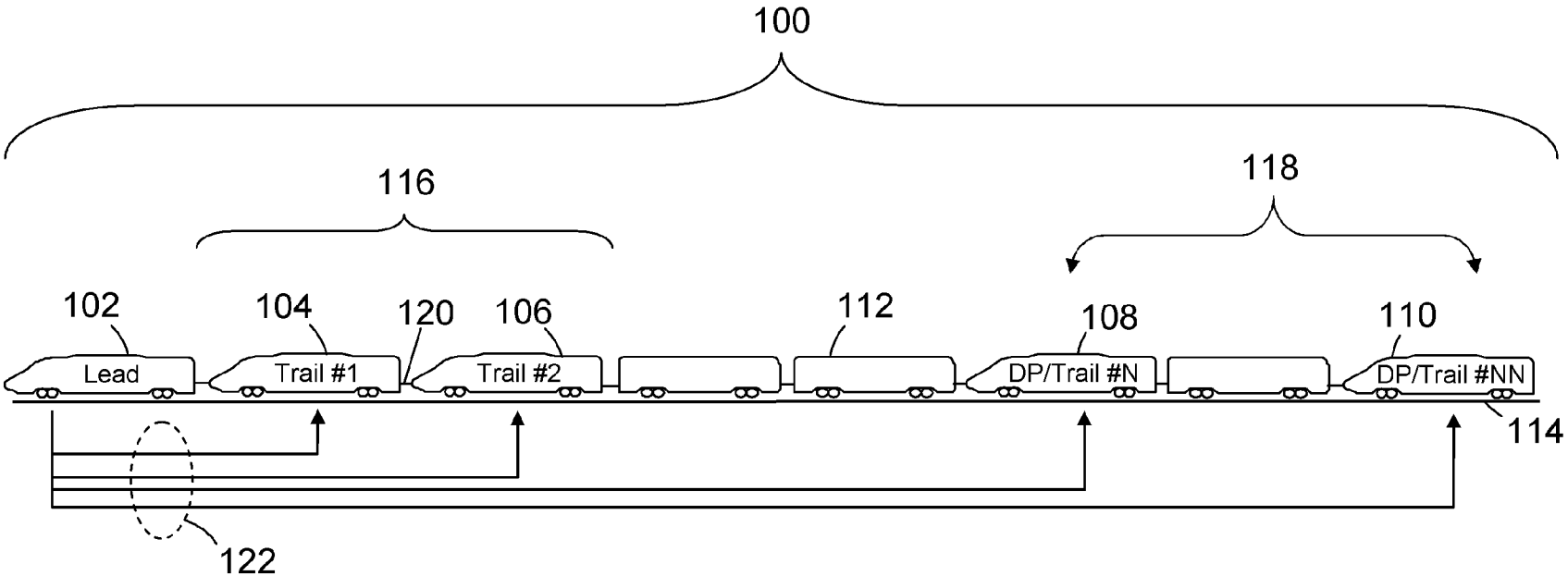
FIG. 1 is a schematic illustration of a rail vehicle system that incorporates an isolation control system constructed in accordance with one embodiment.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with powered rail vehicle systems, the embodiments described herein are not limited to trains. In particular, one or more embodiments may be implemented in connection with different types of rail vehicles (e.g., a vehicle that travels on one or more rails, such as single locomotives and railcars, powered ore carts and other mining vehicles, light rail transit vehicles, and the like) and other vehicles. Example embodiments of systems and methods for remotely isolating remote powered units in a rail vehicle system are provided. At least one technical effect described herein includes a method and system that permits an operator in a lead powered unit to remotely turn a remote powered unit on or off.

FIG. 1 is a schematic illustration of a rail vehicle system 100 that incorporates an isolation control system constructed in accordance with one embodiment. The rail vehicle system 100 includes a lead powered unit 102 coupled with several remote powered units 104, 106, 108, 110 and individual rail cars 112. The rail vehicle system 100 travels along a track 114. The lead powered unit 102 and the remote powered units 104-110 supply a tractive force to propel the rail vehicle system 100 along the track 114. In one embodiment, the lead powered unit 102 is a leading locomotive disposed at the front end of the rail vehicle system 100 and the remote powered units 104-110 are trailing locomotives disposed behind the lead powered unit 102 between the lead powered unit 102 and the back end of the rail vehicle system 100. The individual rail cars 112 may be non-powered storage units for carrying goods and/or passengers along the track 114.

The remote powered units 104-110 are remote from the lead powered unit 102 in that the remote powered units 104-110 are not located within the lead powered unit 102. A remote powered unit 104-110 need not be separated from the lead powered unit 102 by a significant distance in order for the remote powered unit 104-110 to be remote from the lead powered unit 102. For example, the remote powered unit 104 may be directly adjacent to and coupled with the lead powered unit 102 and still be remote from the lead powered unit 102. In one embodiment, the lead powered unit 102 is not located at the front end of the rail vehicle system 100. For example, the lead powered unit 102 may trail one or more individual cars 112 and/or remote powered units 104-110 in the rail vehicle system. Thus, unless otherwise specified, the terms "lead," "remote," and "trailing" are meant to distinguish one rail vehicle from another, and do not require that the lead powered unit be the first powered unit or other rail vehicle in a train or other rail vehicle system, or that the remote powered units be located far away from the lead powered unit or other particular units, or that a "trailing" unit be behind the lead unit or another unit. The number of powered units 102-110 in the rail vehicle system 100 may vary from those shown in FIG. 1.

The remote powered units 104-110 may be organized into groups. In the illustrated embodiment, the remote powered units 104, 106 are organized into a consist group 116. A consist group 116 may include one or more powered units 102-110 that are the same or similar models and/or are the same or similar type of powered unit. For example, a consist group 116 may include remote powered units 104, 106 that are manufactured by the same entity, supply the same or similar tractive force, have the same or similar braking capacity, have the same or similar types of brakes, and the like. The powered units 102-104 in a consist group 116 may be directly coupled with one another or may be separated from one another but interconnected by one or more other components or units.

The remote powered units 108, 110 are organized into a distributed power group 118 in the illustrated embodiment. Similar to a consist group 116, a distributed power group 118 may include one or more powered units 102-110. The powered units 102-110 in a distributed power group 118 may be separated from one another but interconnected with one another by one or more other powered units 102-110 and/or individual cars 112.

In operation, the lead powered unit 102 remotely controls which of the remote powered units 104-110 are turned on and which remote powered units 104-110 are turned off. For example, an operator in the lead powered unit 102 may remotely turn one or more of the remote powered units 104-110 on or off while remaining in the lead powered unit 102. The lead powered unit 102 may remotely turn on or off individual remote powered units 104-110 or entire groups of remote powered units 104-110, such as the remote powered units 104, 106 in the consist group 104-106 and/or the remote powered units 108, 110 in the distributed power group 116. The lead powered unit 102 remotely turns the remote powered units 104-110 on or off when the rail vehicle system 100 is moving along the track 114 and/or when the rail vehicle system 110 is stationary on the track 114.

The remote powered units 104-110 supply tractive forces to propel the rail vehicle system 100 along the track 114 when the respective remote powered units 104-110 are turned on. Conversely, the individual remote powered units 104-110 withhold tractive forces and do not supply a tractive force to propel the rail vehicle system 100 along the track 114 when the respective remote powered units 104-110 are turned off. The lead powered unit 102 may control which of the remote powered units 104-110 are turned on and which of the remote powered units 104-110 are turned off based on a variety of factors. By way of example only, the lead powered unit 102 may turn off some remote powered units 104-110 while leaving other remote powered units 104-110 on if the remote powered units 104-110 that remain on are supplying sufficient tractive force to propel the rail vehicle system 100 along the track 114.

The lead powered unit 102 communicates with the remote powered units 104-110 in order to turn the remote powered units 104-110 on or off. The lead powered unit 102 may communicate instructions to the remote powered units 104-110 via a wired connection 120 and/or a wireless connection 122 between the lead powered unit 102 and the remote powered units 104-110. By way of non-limiting example only, the wired connection 120 may be a wire or group of wires, such as a trainline or MU cables, that extends through the powered units 102-110 and cars 112 of the rail vehicle system 100. The wireless connection 122 may include radio frequency (RF) communication of instructions between the lead powered unit 102 and one or more of the remote powered units 104-110.

Figure 2:
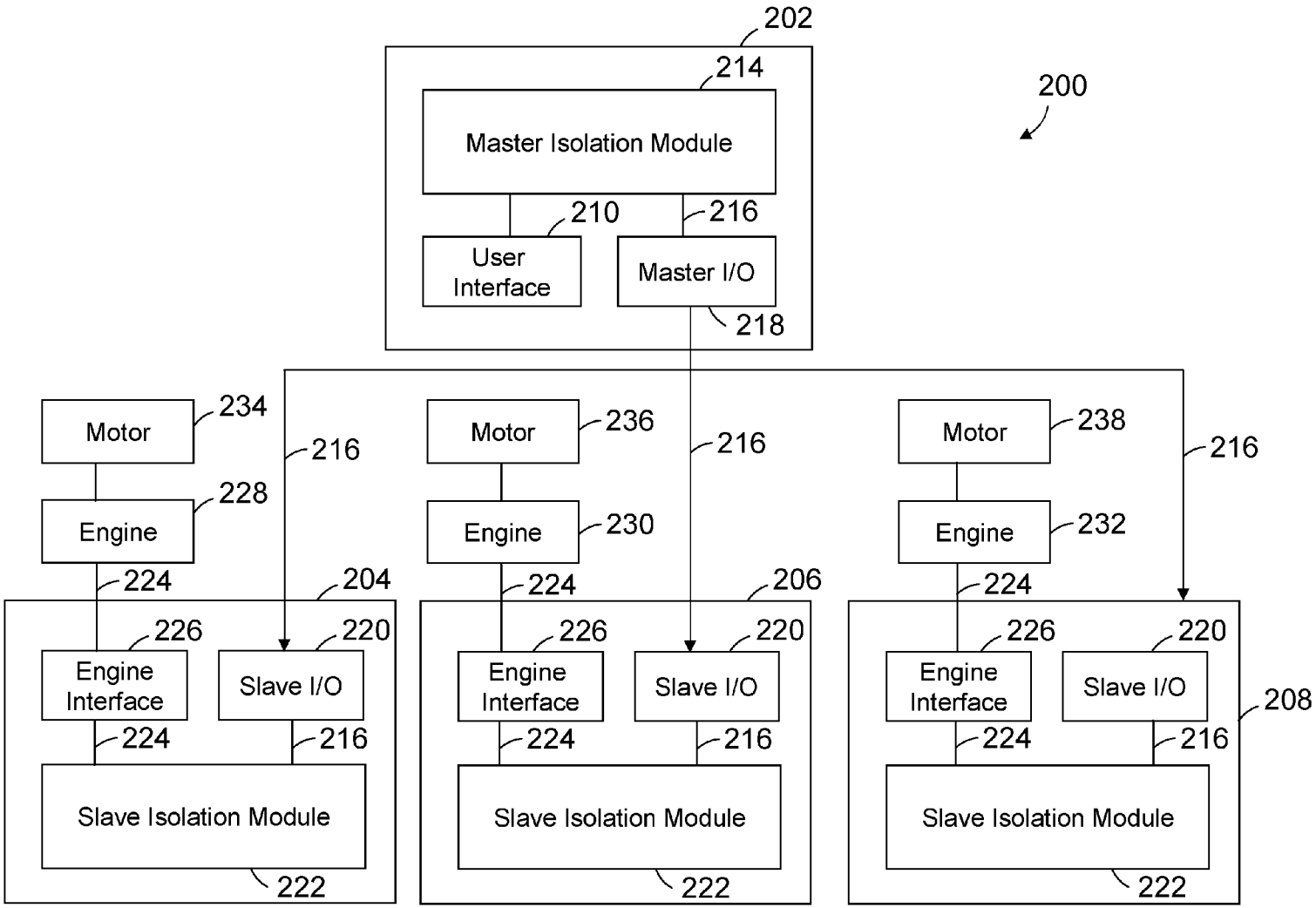
FIG. 2 is a schematic illustration of an isolation control system in accordance with one embodiment.

FIG. 2 is a schematic illustration of the isolation control system 200 in accordance with one embodiment. The isolation control system 200 enables an operator in the lead powered unit 102 (shown in FIG. 1) to remotely change a powered or operational state of one or more of the remote powered units 104-110 (shown in FIG. 1). The powered or operational state of one or more of the remote powered units 104-110 may be an "on" operational state or an "off" operational state based on whether power is supplied to (or by) engines 228-232 of the remote powered units 104-110. For example, a remote powered unit 104 may be turned to an "off" state by shutting off power to the engine 228 in the remote powered unit 104. Depending on the type of engine involved, this may include one or more of the following: communicating with an engine controller or control system that the engine is to be turned off; shutting off a supply of electricity to the engine, where the electricity is required by the engine to operate (e.g., spark plug operation, fuel pump operation, electronic injection pump); shutting off a supply of fuel to the engine; shutting off a supply of ambient air or other intake air to the engine; restricting the output of engine exhaust; or the like. Turning the engine 228-232 of a remote powered unit 104-110 off may prevent the engine 228-232 in the remote powered unit 104-110 from generating electricity. (As should be appreciated, this assumes that the engine output is connected to a generator or alternator, as is common in a locomotive or other powered unit; thus, unless otherwise specified, the term "engine" refers to an engine system including an engine and alternator/generator.) If the engine 228-232 is turned off and does not generate electricity, then the engine 228-232 cannot generate electricity that is fed to one or more corresponding electric motors 234-238 in the remote power units 104-110, and the motors 234-238 may be unable to move the axles and wheels of the remote powered unit 104-110. (In this configuration, common among locomotives and other rail powered units, electric motors are connected to the vehicle axles, via a gear set, for moving the powered unit, while the engine is provided for generating electricity for electrically powering the motors.) In one embodiment, a remote powered unit 104-110 is turned "off" by directing the engine 228-232 in the remote powered unit 104-110 to cease or stop supplying tractive effort. For example, the remote powered unit 104-110 may be turned off by directing the engine 228-232 of the remote powered unit 104-110 to stop supplying electricity to the corresponding motor(s) 234-238 of the remote powered unit 104-110 that provide tractive effort for the remote powered unit 104-110.

In another embodiment, a remote powered unit 104-110 (shown in FIG. 1) may be turned off by completely shutting down the corresponding engine 228-232 of the remote powered unit 104-110. For example, the engine 228-232 may be shut down such that the engine 228-232 is no longer combusting, burning, or otherwise consuming fuel to generate electricity. A remote powered unit 104-110 may be changed to an "off" state by temporarily shutting down the engine 228-232 such that the engine 228-232 is no longer combusting, burning, or otherwise consuming fuel to generate electricity but for periodic or non-periodic and relatively short time periods where the engine 228-232 is changed to an "on" state in order to maintain a designated or predetermined engine temperature. The power that is supplied to the engine 228-232 during the short time periods may be sufficient to cause the engine 228-232 to combust some fuel while being insufficient to enable the engine 228-232 to provide tractive effort to the corresponding remote powered unit 104-110.

In one embodiment, the state of an engine 228-232 of a remote powered unit 104-110 (shown in FIG. 1) is changed to an "off" state when the power that is supplied by the engine 228-232 is reduced below a threshold at which an Automatic Engine Start/Stop (AESS) system assumes control of the powered or operating state of the engine 228-232. For example, the engine 228 of the remote powered unit 104 may be shut off by decreasing the power supplied by the engine 228 to the motor 234 until the supplied power falls below a predetermined threshold at which the AESS system takes over control of the engine 228 and determines when to turn the engine 228 completely off. Alternatively, the engines 228-232 of the remote powered units 104-110 may be individually turned on or off independent of an AESS system. For example, the engine 228-232 of a remote powered unit 110 may be turned on or off regardless of whether the engine 228-232 is susceptible to control by an AESS system.

The isolation control system 200 may remotely change the powered state of the engine(s) of one or more of the remote powered units 104-110 (shown in FIG. 1) in accordance with one or more of the embodiments described above. The isolation control system 200 includes a master isolation unit 202 and several slave controllers 204, 206, 208. In one embodiment, the master isolation unit 202 is disposed in the lead powered unit 102. Alternatively, only a part or subsection of the master isolation unit 202 is disposed in the lead powered unit 102. For example, a user interface 210 of the master isolation unit 202 may be located in the lead powered unit 102 while one or more other components of the master isolation unit 202 are disposed outside of the lead powered unit 102. The slave controllers 204-208 are disposed in one or more of the remote powered units 104-110. For example, the slave controller 204 may be located within the remote powered unit 104, the slave controller 206 may be disposed in the remote powered unit 106, and the slave controller 208 may be located at the remote powered unit 108. The number of slave controllers 204-208 in the isolation control system 200 may be different from the embodiment shown in FIG. 2. Similar to the master isolation unit 202, one or more components or parts of the slave controllers 204-208 may be disposed outside of the corresponding remote powered units 104-110. The master isolation unit 202 and/or slave controllers 204-208 may be embodied in one or more wired circuits with discrete logic components, microprocessor-based computing systems, and the like. As described below, the master isolation unit 202 and/or the slave controllers 204-208 may include microprocessors that enable the lead powered unit 102 (shown in FIG. 1) to remotely turn the remote powered units 104-110 on or off. For example, one or more microprocessors in the master isolation unit 202 and/or slave controllers 204-208 may generate and communicate signals between the master isolation unit and the slave controllers 204-208 that direct one or more of the corresponding engines 228-232 of the remote powered units 104-110 to change the powered state of the engines 228-232 from an "on" state to an "off" state, as described above.

The master isolation unit 202 includes the user interface 210 that accepts input from an operator of the master isolation unit 202. For example, the user interface 210 may accept commands or directions from an engineer or other operator of the lead powered unit 102 (shown in FIG. 1). By way of non-limiting example only, the user interface 210 may be any one or more of a rotary switch, a toggle switch, a touch sensitive display screen, a keyboard, a pushbutton, a software application or module running on a processor-based computing device, and the like. The operator inputs an isolation command 212 into the user interface 210. The isolation command 212 represents a request by the operator to turn one or more of the remote powered units 104-110 on and/or to turn one or more of the remote powered units 104-110 off. The user interface 210 communicates the operator's request to a master isolation module 214.

The master isolation module 214 receives the operator's request from the user interface 210 and determines which ones of the remote powered units 104-110 (shown in FIG. 1) are to be turned on and/or which ones of the remote powered units 104-110 are to be turned off. For example, the isolation command 212 may request that a single remote powered unit 106 be turned off or on. Alternatively, the isolation command 212 may request that a group of the remote powered units 104-110 be turned on or off. For example, the isolation command 212 may select the remote powered units 104-110 in a selected consist group 116 and/or a distributed power group 118 (shown in FIG. 1) be turned off or on. By way of non-limiting example only, the master isolation module 214 may be embodied in any one or more of hardwired circuitry, rotary, or other types, of switches, a microprocessor based device, a software application or module running on a computing device, a discrete logic device, and the like. Based on the operator's request communicated via the isolation command 212, the master isolation module 214 conveys an isolation instruction 216 to a master input/output (I/O) device 218.

The master I/O device 218 is a device that communicates the isolation instruction 216 to the remote powered units 104-110 (shown in FIG. 1) selected by the master isolation module 214. For example, if the isolation command 212 from the operator requests that one or more individual remote powered units 104-110 be turned off or on, or that the remote powered units 104-110 in a selected consist or distributed power group 116, 118 be turned off or on, the master I/O device 218 communicates the isolation instruction 216 to at least those remote powered units 104-110 selected by the isolation command 212. By way of non-limiting example only, the master I/O device 218 may be embodied in one or more of a connector port that is electronically coupled with one or more wires joined with the remote powered units 104-110 (such as a trainline), an RF transmitter, a wireless transceiver, and the like. In one embodiment, the master I/O device 218 conveys the isolation instruction 216 to all of the remote powered units 104-110 in the rail vehicle system 100 (shown in FIG. 1). While the illustrated embodiment shows the isolation instruction 216 being communicated in parallel to the slave controllers 204-208, the isolation instruction 216 may be serially communicated among the slave controllers 204-208. For example, the master I/O device 218 may serially convey the isolation instruction 216 to the remote powered units 104-110 along a trainline. The remote powered units 104-110 that are to be turned on or off by the isolation instruction 216 receive the isolation instruction 216 and act on the isolation instruction 216. The remote powered units 104-110 that are not to be turned on or off by the isolation instruction 216 ignore the isolation instruction 216. For example, the remote powered units 104-110 may include discrete logic components that are coupled with a trainline and that receive the isolation instruction 216 when the isolation instruction 216 relates to the remote powered units 104-110 and ignores the isolation instruction 216 when the isolation instruction 216 does not relate to the remote powered units 104-110.

In another embodiment, the master I/O device 218 broadcasts the isolation instruction 216 to all of the remote powered units 104-110 (shown in FIG. 1) in the rail vehicle system 100 (shown in FIG. 1). For example, the master I/O device 218 may include a wireless transceiver that transmits data packets comprising the isolation instruction 216 to the remote powered units 104-110. Alternatively, the master I/O device 218 may be an RF transmitter that transits a radio frequency signal that includes the isolation instruction 216. The remote powered units 104-110 may be associated with unique identifiers, such as serial numbers, that distinguish the remote powered units 104-110 from one another. The isolation instruction 216 may include or be associated with one or more of the unique identifiers to determine which of the remote powered units 104-110 are to receive and act on the isolation instruction 216. For example, if the unique identifier of a remote powered unit 104-110 matches an identifier stored in a header of a data packet of the isolation instruction 216 or communicated in the RF signal, then the remote powered unit 104-110 having the mating unique identifier receives and acts on the isolation instruction 216.

A slave input/output (I/O) device 220 receives the isolation instruction 216 from the master I/O device 218. By way of non-limiting example only, the slave I/O devices 220 may be embodied in one or more of a connector port that is electronically coupled with one or more wires joined with the lead powered unit 102 (such as a trainline), an RF transmitter, a wireless transceiver, and the like. The slave I/O devices 220 convey the isolation instruction 216 to a slave isolation module 222.

The slave isolation module 222 receives the isolation instruction 216 from the slave I/O device 220 and determines if the corresponding remote powered unit 104-110 (shown in FIG. 1) is to be turned on or off in response to the isolation instruction 216. The slave isolation module 222 may include logic components to enable the slave isolation module 222 to determine whether the associated remote powered unit 104-110 (shown in FIG. 1) is to obey or ignore the isolation instruction 216. For example, the slave isolation modules 222 may include one or more of hardwired circuitry, relay switches, a microprocessor based device, a software application or module running on a computing device, and the like, to determine if the associated remote powered unit 104-110 is to act on the isolation instruction 216.

If the slave isolation module 222 determines that the corresponding remote powered unit 104-110 (shown in FIG. 1) is to be turned on or off in response to the isolation instruction 216, then the slave isolation module 222 communicates an appropriate command 224 to an engine interface device 226. The engine interface device 226 receives the command 224 from the slave isolation module 222 and, based on the command 224, directs the engine 228, 230, 232 of the corresponding remote powered unit 104-110 to turn on or off. For example, the engine interface device 226 associated with the remote powered unit 104 may communicate the command 224 to the engine 228 of the remote powered unit 104. By way of non-limiting example only, the engine interfaces 226 may be embodied in one or more of a connector port that is electronically coupled with the engines 228-232 via one or more wires. Upon receiving the command 224 from the engine interfaces 226, the engines 228-232 may change operational states from "on" to "off," or from "off" to "on." As described above, in one embodiment, the engines 228-232 may turn off and cease supplying electricity to a corresponding motor 234-238 in order to cause the motor 234-238 to supply or withhold application of tractive force. For example, if the engine 230 receives a command 224 directing the engine 230 to turn off and the engine 232 receives a command 224 directing the engine 232 to turn on, then the engine 230 shuts down and stops providing electricity to the motor 236, which in turn stops providing a tractive force to propel the rail vehicle system 100 (shown in FIG. 1), while the engine 232 turns on and begins supplying electricity to the motor 238 to cause the motor 238 to provide a tractive force to propel the rail vehicle system 100.

In one embodiment, the engine 228-232 turns on or off within a predetermined time period. For example, an engine 228 that is used to supply tractive effort may shut off within a predetermined time period after the slave isolation module 222 receives the isolation instruction 216. The predetermined time period may be established or set by an operator of the system 200. The turning on or off of the engine 228-232 within a predetermined time period after the slave isolation module 222 receives the isolation instruction 216 may permit an operator in the lead powered unit 102 (shown in FIG. 1) to send the isolation instruction 216 to the remote powered units 104-110 (shown in FIG. 1) to turn off the engines 228-232 immediately, or at least relatively soon after the isolation command 212 is input into the user interface 210. For example, the slave isolation modules 222 may turn off the engines 228-232 without waiting for the engines 228-232 to cool down to a threshold temperature.

The master isolation unit 202 may convey additional isolation instructions 216 to the slave controllers 204-208 during a trip. A trip includes a predetermined route between two or more waypoints or geographic locations over which the rail vehicle system 100 (shown in FIG. 1) moves. For example, an operator in the lead powered unit 102 (shown in FIG. 1) may periodically input isolation commands 212 into the master isolation unit 202 to vary the total amount of tractive force supplied by the powered units 102-110 (shown in FIG. 1). The operator may vary the number and/or type of powered units 102-110 being used to supply tractive force to propel the rail vehicle system 100 during the trip in order to account for various static or dynamically changing factors and parameters, such as, but not limited to, a speed limit of the rail vehicle system 100, a changing grade and/or curvature of the track 114 (shown in FIG. 1), the weight of the rail vehicle system 100, a distance of the trip, a distance of a segment or subset of the trip, a performance capability of one or more of the powered units 102-110, a predetermined speed of the rail vehicle system 100, and the like.

Figure 3:
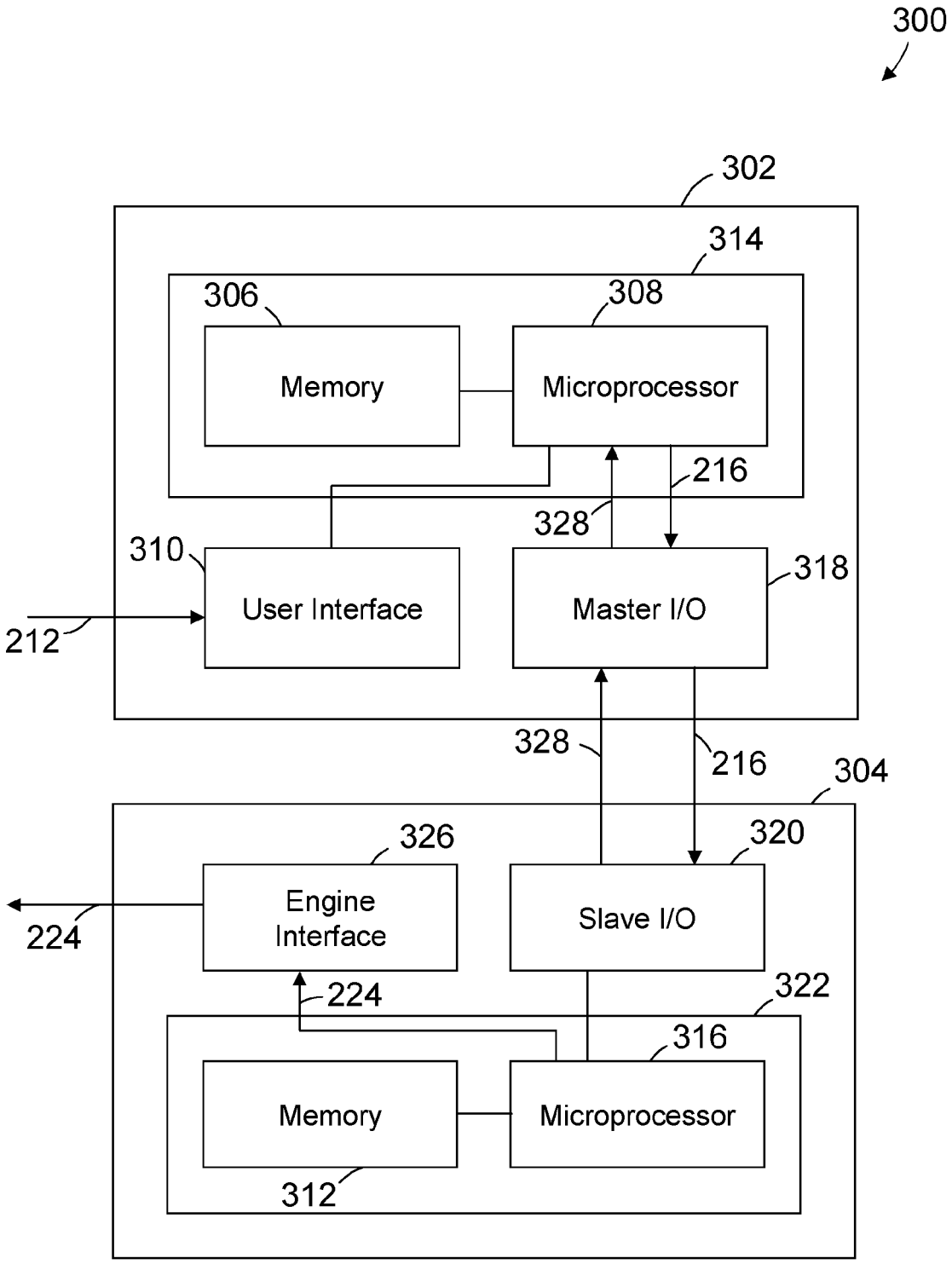
FIG. 3 is a schematic diagram of an isolation control system in accordance with another embodiment.

FIG. 3 is a schematic diagram of an isolation control system 300 in accordance with another embodiment. The control system 300 may be similar to the control system 200 (shown in FIG. 2). For example, the control system 300 may be used to remotely turn one or more remote powered units 104-110 (shown in FIG. 1) on or off from the lead powered unit 102 (shown in FIG. 1). The control system 300 is a microprocessor-based control system. For example, the control system 300 includes one or more microprocessors 308, 320 that permit an operator to manually turn one or more of the remote powered units 104-110 on or off. Additionally, the control system 300 may be utilized to automatically turn one or more of the remote powered units 104-110 on or off.

The control system 300 includes a master isolation unit 302 and a slave controller 304. The master isolation unit 302 may be similar to the master isolation unit 202 (shown in FIG. 2). For example, the master isolation unit 302 includes a master isolation module 314, a user interface 310, and a master I/O device 318. The user interface 310 may be the same as, or similar to, the user interface 210 (shown in FIG. 2) and the master I/O device 318 may be the same as, or similar to, the master I/O device 218 (shown in FIG. 2). The master isolation module 314 includes a memory 306 and a microprocessor 308. The memory 306 represents a computer readable storage device or medium. The memory 306 may include sets of instructions that are used by the microprocessor 308 to carry out one or more operations. By way of example only, the memory 306 may be embodied in one or more of an electrically erasable programmable read only memory (EEPROM), a read only memory (ROM), a programmable read only memory (PROM), an erasable programmable read only memory (EPROM), or FLASH memory. The microprocessor 308 represents a processor, microcontroller, computer, or other electronic computing or control device that is configured to execute executing instructions stored on the memory 306. (Thus, unless otherwise specified, the term "microprocessor" includes any of the aforementioned devices.)

The slave controller 304 may be similar to one or more of the slave controllers 204-208 (shown in FIG. 2). For example, the slave controller 304 includes a slave isolation module 322, an engine interface 326, and a slave I/O device 320. The engine interface 326 may be the same as, or similar to, the engine interface 226 (shown in FIG. 2) and the slave I/O device 320 may be the same as, or similar to, the slave I/O device 220 (shown in FIG. 2). The slave isolation module 322 may include a memory 312 and a microprocessor 316. Alternatively, one or more of the slave controllers 304 in the remote powered units 104-110 (shown in FIG. 1) does not include memories 312 and/or microprocessors 316. The memory 312 may be the same as, or similar to, the memory 306 in the master isolation module 314 and the microprocessor 316 may be the same as, or similar to, the microprocessor 308 in the master isolation module 314.

In operation, the master isolation unit 302 remotely turns the engines 228-232 (shown in FIG. 2) on or off in a manner similar to the master isolation unit 202 (shown in FIG. 2). The user interface 310 receives the isolation command 212 and communicates the isolation command 212 to the microprocessor 308 of the master isolation module 314. The master isolation module 314 receives the isolation command 212 and determines which remote powered units 104-110 (shown in FIG. 1) are to be turned on or off based on the isolation command 212. The master isolation module 314 may query the memory 306 to determine which remote powered units 104-110 to turn on or off. For example, if the isolation command 212 requests that the remote powered units 104-110 in a selected consist or distributed power group 116, 118 (shown in FIG. 1) be turned off, the microprocessor 308 may request a list of the remote powered units 104-110 that are in the selected consist or distributed power group 116, 118. The master isolation module 314 then sends the isolation instruction 216 to the master I/O device 318, which conveys the isolation instruction 216 to the selected remote powered units 104-110. For example, the microprocessor 308 may direct the master I/O device 318 to communicate the isolation instruction 216 only to the remote powered units 104-110 selected by the isolation command 212. In another example, the microprocessor 308 may embed identifying information in the isolation command 212. As described above, the identifying information may be compared to a unique identifier associated with each remote powered unit 104-110 to determine which of the remote powered units 104-110 are to act on the isolation instruction 216.

In one embodiment, the master isolation module 314 automatically generates the isolation instruction 216 and communicates the isolation instruction 216 to one or more of the remote powered units 104-110 (shown in FIG. 1). For example, the master isolation module 314 may determine a tractive effort needed or required to propel the rail vehicle system 100 (shown in FIG. 1) along a trip or a segment of the trip. The microprocessor 308 may calculate the required tractive effort from information and data stored in the memory 306. By way of example only, the microprocessor 308 may obtain and determine the required tractive effort based on the distance of the trip, the distance of one or more of the trip segments, the performance capabilities of one or more of the powered units 102-110 (shown in FIG. 1), the curvature and/or grade of the track 114 (shown in FIG. 1), transit times over the entire trip or a trip segment, speed limits, and the like.

As the rail vehicle system 100 (shown in FIG. 1) moves along the track 114 (shown in FIG. 1) during the trip, the microprocessor 308 of the master isolation module 314 may adaptively generate and communicate isolation instructions 216 to the slave controllers 304 of the remote powered units 104-110 (shown in FIG. 1) to vary which of the remote powered units 104-110 are turned on or off. During some segments of a trip, the required tractive effort may increase. For example, if the grade of the track 114 or the speed limit increases, the microprocessor 308 may determine that additional remote powered units 104-110 need to be turned on to increase the total tractive force provided by the powered units 102-110 (shown in FIG. 1). The microprocessor 308 may automatically generate an isolation instruction 216 that turns on one or more remote powered units 104-110 that previously were turned off. Alternatively, during other segments of a trip, the required tractive effort may decrease. For example, if the grade of the track 114 or the speed limit decreases, the microprocessor 308 may determine that fewer remote powered units 104-110 are needed to propel the rail vehicle system 100. The microprocessor 308 may automatically generate an isolation instruction 216 that turns off one or more remote powered units 104-110 that previously were turned on. The selection of which remote powered units 104-110 are turned on or off may be based on the performance capabilities of the remote powered units 104-110. The performance capabilities may include the tractive force provided by the various remote powered units 104-110, the rate at which the remote powered units 104-110 burn fuel, an exhaust emission of the remote powered units 104-110, an EPA Tier level of the remote powered units 104-110, the horsepower to weight ratio of the remote powered units 104-110, and the like.

The slave controllers 304 of one or more of the remote powered units 104-110 (shown in FIG. 1) receive the isolation instruction 216 and, based on the isolation instruction 216, turn the corresponding engines 228-232 (shown in FIG. 2) on or off, similar to as described above. In one embodiment, the microprocessors 316 in the slave controllers 304 receive the isolation instruction 216 and determine if the isolation instruction 216 applies to the corresponding remote powered unit 104-110. For example, the microprocessor 316 may compare identifying information in the isolation instruction 216 to a unique identifier stored in the memory 312 and associated with the corresponding remote powered unit 104-110. If the identifying information and the unique identifier match, the microprocessor 316 generates and communicates the command 224 to the engine interface 326. As described above, the engine interface 326 receives the command 224 and turns the associated engine 228-232 on or off based on the command 224.

In one embodiment, the slave controller 304 of one or more of the remote powered units 104-110 (shown in FIG. 1) provide feedback 328 to the master isolation unit 302. Based on the feedback 328, the master isolation unit 302 may automatically generate and communicate isolation instructions 216 to turn one or more of the remote powered units 104-110 on or off. Alternatively, the master isolation unit 302 may determine a recommended course of action based on the feedback 328 and report the recommended course of action to an operator. For example, the master isolation unit 302 may display several alternative courses of action on a display device that is included with or communicatively coupled with the user interface 310. An operator may then use the user interface 310 to select which of the courses of action to take. The master isolation module 314 then generates and communicates the corresponding isolation instruction 216 based on the selected course of action.

The feedback 328 may include different amounts of fuel that are consumed or burned by the remote powered units 104-110 (shown in FIG. 1). For example, the microprocessor 316 in at least one of the remote powered units 104-110 may calculate the various amounts of fuel that will be consumed by the powered units 102-110 (shown in FIG. 1) of the rail vehicle system 100 (shown in FIG. 1) over a time period with different combinations of the powered units 102-110 turned on or off. In one embodiment, a microprocessor 316 in each consist group 116 (shown in FIG. 1) and/or distributed power group 118 (shown in FIG. 1) calculates the amount of fuel that will be consumed by the rail vehicle system 100 with the remote powered units 104-110 in the corresponding consist or distributed power group 116, 118 turned on and the amount of fuel that will be consumed by the rail vehicle system 100 with the remote powered units 104-110 in the consist or distributed power group 116, 118 turned off. The calculated amounts of fuel are conveyed to the slave I/O device 320 and reported to the master isolation unit 302 as the feedback 328. Based on the feedback 328, the master isolation unit 302 determines whether to turn on or off one or more of the remote powered units 104-110. For example, each consist group 116 and/or distributed power group 118 may provide feedback 328 that notifies the master isolation unit 302 of the different amounts of fuel that will be consumed if the various groups 116, 118 are turned on or off. The microprocessor 308 in the master isolation unit 302 examines the feedback 328 and may generate automated isolation instructions 216 to turn one or more of the remote powered units 104-110 on or off based on the feedback 328.

As described above and as an alternative to microprocessor-based remote control of which remote powered units 104-

110 (shown in FIG. 1) are turned on or off, the control system 200 (shown in FIG. 2) may use various circuits and switches to communicate the isolation instructions 216 (shown in FIG. 2) and to determine whether particular remote powered units 104-110 are to act on the isolation instructions 216. By way of example only, the powered units 102-110 (shown in FIG. 1) may include rotary switches that are joined with a trainline extending through the rail vehicle system 100. Based on the positions of the rotary switches, the remote powered units 104-110 may be remotely turned on or off from the lead powered unit 102. For example, if the rotary switches in each of the lead powered unit 102 and the remote powered units 104,106 are in a first position while the rotary switches in the remote powered units 108, 110 are in a second position, then the isolation instruction 216 is acted on by the remote powered units 104, 106 while the remote powered units 108, 110 ignore the isolation instruction 216.

Figure 4:
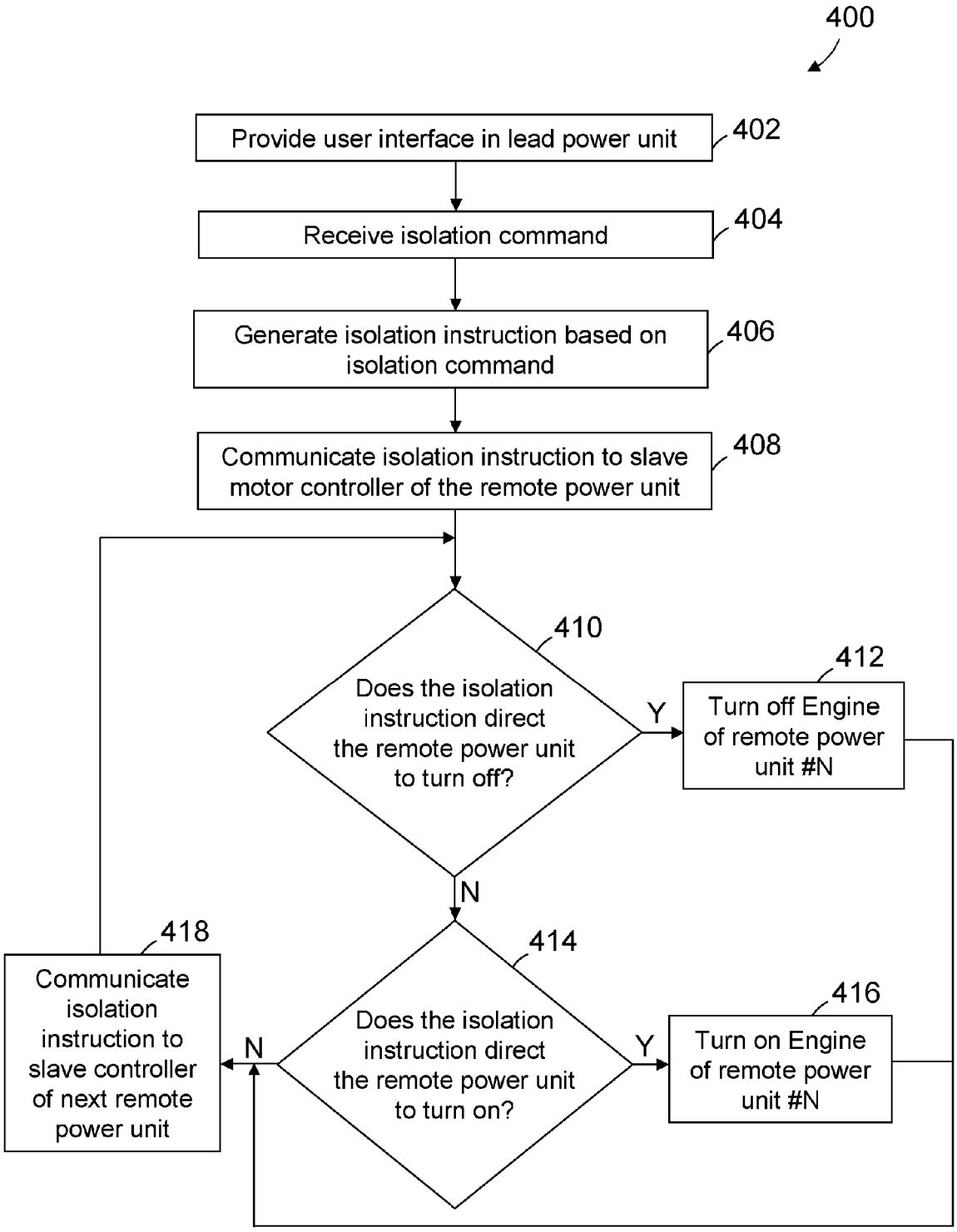
FIG. 4 is a flowchart for a method of controlling a rail vehicle system that includes a lead powered unit and a remote powered unit in accordance with one embodiment.

FIG. 4 is a flowchart for a method 400 of controlling a train that includes a lead powered unit and a remote powered unit in accordance with one embodiment. For example, the method 400 may be used to permit an operator in the lead powered unit 102 (shown in FIG. 1) to remotely turn one or more of the remote powered units 104-110 (shown in FIG. 1) on or off. At 402, a user interface is provided in the lead powered unit. For example, the user interface 210, 310 (shown in FIGS. 2 and 3) may be provided in the lead powered unit 102. The master isolation unit 202, 302 (shown in FIGS. 2 and 3) also may be provided in the lead powered unit 102. At 404, an isolation command is received by the user interface. For example, the isolation command 212 may be received by the user interface 210 or 310.

At 406, an isolation instruction is generated based on the isolation command. For example, the isolation instruction 216 (shown in FIG. 2) may be generated by the master isolation module 214, 314 (shown in FIGS. 2 and 3) based on the isolation command 212. At 408-418, the isolation instruction is communicated to the slave controllers of the remote powered units in a serial manner. For example, the isolation instruction 216 is serially communicated among the remote powered units 104-110 (shown in FIG. 1). Alternatively, the isolation instruction 216 is communicated to the slave controllers 204-208, 304 (shown in FIGS. 2 and 3) of the remote powered units 104-110 in parallel.

At 408, the isolation instruction is communicated to the slave controller of one of the remote powered units. For example, the isolation instruction 216 (shown in FIG. 2) may be communicated to the slave controller 204, 304 (shown in FIGS. 2 and 3) of the remote powered unit 104 (shown in FIG. 1). At 410, the isolation instruction is examined to determine if the isolation instruction directs the slave controller that received the isolation instruction to turn off the engine of the corresponding remote powered unit. If the isolation instruction does direct the slave controller to turn off the engine, flow of the method 400 continues to 412. At 412, the engine of the remote powered unit is turned off and flow of the method 400 continues to 418. On the other hand, if the isolation instruction does not direct the slave controller to turn the engine off, flow of the method 400 continues to 414. For example, the isolation instruction 216 may be examined by the slave isolation module 222, 322 (shown in FIGS. 2 and 3) of the remote powered unit 104 to determine if the isolation instruction 216 directs the remote powered unit 104 to turn off. If the isolation instruction 216 directs the remote powered unit 104 to turn off, the slave controller 204, 304 directs the engine 228 (shown in FIG. 2) of the remote powered unit 104 to turn off. Otherwise, the slave controller 204, 304 does not direct the engine 228 to turn off.

At 414, the isolation instruction is examined to determine if the isolation instruction directs the slave controller that received the isolation instruction to turn on the engine of the corresponding remote powered unit. If the isolation instruction does direct the slave controller to turn on the engine, flow of the method 400 continues to 416. At 416, the engine of the remote powered unit is turned on. For example, the isolation instruction 216 (shown in FIG. 2) may be examined by the slave isolation module 222, 322 (shown in FIGS. 2 and 3) of the remote powered unit 104 (shown in FIG. 1) to determine if the isolation instruction 216 directs the remote powered unit 104 to turn on. If the isolation instruction 216 directs the remote powered unit 104 to turn on, the slave controller 204, 304 directs the engine 228 (shown in FIG. 2) of the remote powered unit 104 to turn on. On the other hand, if the isolation instruction does not direct the slave controller to turn the engine on, flow of the method 400 continues to 418.

At 418, the isolation instruction is communicated to the slave controller of the next remote powered unit. For example, after being received and examined by the slave controller 204, 304 (shown in FIGS. 2 and 3) of the remote powered unit 104 (shown in FIG. 1), the isolation instruction 216 is conveyed to the slave controller 204, 304 of the remote powered unit 106 (shown in FIG. 1). Flow of the method 400 may then return to 410, where the isolation instruction is examined by the next remote powered unit in a manner similar to as described above. The method 400 may continue in a loop-wise manner through 410-418 until the remote powered units have examined and acted on, or ignored, the isolation instruction.

In another embodiment, the method 400 does not communicate and examine the isolation instructions in a serial manner through the remote powered units. Instead, the method 400 communicates the isolation instruction to the remote powered units in a parallel manner. For example, each of the remote powered units 104-110 (shown in FIG. 1) may receive the isolation instruction 216 (shown in FIG. 2) in parallel and act on, or ignore, the isolation instruction 216 in a manner described above in connection with 410-414.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person skilled in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A control system for a rail vehicle system that includes a lead powered unit and a plurality of remote powered units, the system comprising:

a master isolation module configured to receive an isolation command and to communicate an instruction based on the isolation command; and a slave controller configured to receive the instruction from the master isolation module, the slave controller configured to cause at least one of the remote powered units to supply tractive force to propel the rail vehicle system when the instruction directs the slave controller to turn on the at least one of the remote powered units and the slave controller configured to cause the at least one of the remote powered units to withhold the tractive force when the instruction directs the slave controller to turn off the at least one of the remote powered units, and the slave controller is configured to calculate a plurality of different amounts of fuel that will be consumed by different respective combinations of the remote powered units being turned on or off, wherein the slave controller is configured to report the amounts of fuel to the master isolation module, the master isolation module is configured to identify at least one combination of the remote powered units to be turned on or off based on the amounts of fuel, and the master isolation module is configured to form the isolation command based on the at least one combination of the remote powered units.

2. The system of claim 1, wherein the remote powered units are organized into groups and the master isolation module is configured to communicate the instruction to the remote powered units in a selected group when the isolation command directs the remote powered units in the selected group to be turned on or off.

3. The system of claim 1, wherein the rail vehicle system includes a plurality of the slave controllers, each of the remote powered units including at least one of the slave controllers, wherein the master isolation module is configured to communicate the instruction to individual ones of the remote powered units to individually direct the corresponding slave controllers to cause the individual ones of the remote powered units to supply or withhold the tractive force.

4. The system of claim 1, wherein the master isolation module is configured to communicate the instruction and the slave controller is configured to direct the remote powered unit to supply or withhold the tractive force while the remote powered unit is moving.

5. The system of claim 1, wherein the instruction is configured to direct the slave controller to cause the remote powered unit to supply or withhold the tractive force within a predetermined time period after the instruction is received at the slave controller.

6. The system of claim 1, wherein the master isolation module comprises a memory and a microprocessor, the memory configured to store a tractive effort required to propel the rail vehicle system during a predetermined trip, the microprocessor configured to generate and communicate an automated instruction to the slave controller to turn the at least one of the remote powered units on or off based on the tractive effort.

7. The system of claim 6, wherein the memory is configured to store the trip as trip segments having different tractive efforts for sections of the trip, further wherein the microprocessor is configured to adaptively generate and communicate automated instructions to the slave controller to turn the at least one of the remote powered units on or off based on the different tractive efforts.

8. The system of claim 7, wherein the rail vehicle system includes a plurality of the slave controllers, each of the remote powered units including at least one of the slave controllers, wherein the microprocessor is configured to adaptively generate and communicate automated instructions to the slave controllers to vary which of the remote powered units are turned on and which of the remote powered units are turned off during the different trip segments.

9. The system of claim 6, wherein the tractive effort is based on at least one of a weight of the rail vehicle system, a distance of the trip, a distance of a segment of the trip, a performance capability of the remote powered unit, a curvature of track along the trip, a grade of the trip, or a transit time between waypoints along the trip.

10. A method for controlling a rail vehicle system that includes a lead powered unit and a plurality of remote powered units, the method comprising:

calculating a plurality of amounts of fuel that will be consumed by different combinations of the remote powered units being turned on or off;

at the lead powered unit, generating an isolation command to turn on or off the remote powered unit based on the amounts of fuel related to the different combinations of the remote powered units being turned on or off;

communicating an instruction based on the isolation command to a slave controller in at least one of the remote powered units; and causing the at least one of the remote powered units to supply tractive force to propel the rail vehicle system when the instruction directs the slave controller to turn on the at least one of the remote powered units and to withhold the tractive force when the instruction directs the slave controller to turn off the at least one of the remote powered units.

11. The method of claim 10, wherein the rail vehicle system includes the remote powered units organized into groups, further wherein the communicating operation includes conveying the instruction to the remote powered units in a selected group when the isolation command directs the remote powered units in the selected group to be turned on or off.

12. The method of claim 10, wherein the rail vehicle system includes a plurality of the slave controllers, and the communicating operation comprises conveying the instruction to individual ones of the remote powered units to individually direct the corresponding slave controllers to cause the individual ones of the remote powered units to supply or withhold the tractive force.

13. The method of claim 10, wherein based on the instruction, the slave controller causes the at least one of the remote powered units to supply or withhold the tractive force while the at least one of the remote powered units is moving.

14. The method of claim 10, wherein the slave controller causes the at least one of the remote powered units to supply or withhold the tractive force within a predetermined time period after the instruction is received at the slave controller.

15. The method of claim 10, wherein the generating operation includes forming an automated instruction to the slave controller to turn the at least one of the remote powered units on or off based on the amounts of fuel.

16. A non-transitory computer readable storage medium for a control system of a rail vehicle system having a lead powered unit and a plurality of remote powered units, the lead powered unit including a first microprocessor, one or more of the remote powered units including a second microprocessor, the computer readable storage medium comprising:

second instructions configured to direct the second microprocessor of the one or more of the remote powered units to:

calculate a plurality of amounts of fuel that will be consumed by different combinations of the remote powered units being turned on or off; and communicate the amounts of fuel to the lead powered unit; and first instructions configured to direct the first microprocessor of the lead powered unit to:

generate an isolation command configured to turn on or off at least one of the remote powered units based on the amounts of fuel received from the one or more of the remote powered units; and communicate an instruction based on the isolation command to the at least one of the remote powered units, wherein the at least one of the remote powered units is configured to supply tractive force to propel the rail vehicle system when the instruction directs the at least one of the remote powered units to turn on and the at least one of the remote powered units is configured to withhold the tractive force when the instruction directs the at least one of the remote powered units to turn off.

17. The non-transitory computer readable storage medium of claim 16, wherein the remote powered units are organized into groups, further wherein the second instructions are configured to direct the second microprocessor of the lead powered unit to communicate the instruction to one or more of the remote powered units in a selected group when the isolation command is configured to direct the remote powered units in the selected group to be turned on or off.

18. The non-transitory computer readable storage medium of claim 16, wherein the lead powered unit comprises a memory, further wherein:

the first instructions are configured to direct the first microprocessor to store a tractive effort required to propel the rail vehicle system along a track during a predetermined trip in the memory; and the first instructions are configured to direct the first microprocessor of the lead powered unit to generate and communicate an automated instruction to the at least one of the remote powered units to turn the at least one of the remote powered units on or off based on the tractive effort.

19. The non-transitory computer readable storage medium of claim 18, wherein:

the first instructions are configured to direct the first microprocessor to store the trip as trip segments having different tractive efforts for sections of the trip in the memory; and the first instructions are configured to direct the first microprocessor of the lead powered unit to adaptively generate and communicate automated instructions to the at least one of the remote powered units to turn the at least one of the remote powered units on or off based on the different tractive efforts.

20. The non-transitory computer readable storage medium of claim 19, wherein the first instructions are configured to direct the first microprocessor of the lead powered unit to adaptively generate and communicate automated instructions to the remote powered units to vary which of the remote powered units are turned on and which of the remote powered units are turned off during the different trip segments.

21. The system of claim 1, wherein at least a first combination of the different combinations of the remote powered units includes one or more different remote powered units being turned off relative to a different, second combination of the different combinations of the remote powered units.

* * * * *